US011096510B2

(12) United States Patent
Tucker

(10) Patent No.: US 11,096,510 B2
(45) Date of Patent: Aug. 24, 2021

(54) SELF-ASSEMBLING ARTIFICIAL TREE

(71) Applicant: Tiffani Tucker, Waxahachie, TX (US)

(72) Inventor: Tiffani Tucker, Waxahachie, TX (US)

( * ) Notice: Subject to any disclaimer, the term of this patent is extended or adjusted under 35 U.S.C. 154(b) by 124 days.

(21) Appl. No.: 16/534,654

(22) Filed: Aug. 7, 2019

(65) Prior Publication Data

US 2021/0038007 A1 Feb. 11, 2021

(51) Int. Cl.
*A47G 33/06* (2006.01)

(52) U.S. Cl.
CPC ..... *A47G 33/06* (2013.01)

(58) Field of Classification Search
CPC ..... A47G 33/06; A47G 33/04
See application file for complete search history.

(56) References Cited

U.S. PATENT DOCUMENTS

2005/0048226 A1* 3/2005 Gary ..... A47G 33/06 428/18
2019/0313829 A1* 10/2019 Meger ..... A47G 33/12

FOREIGN PATENT DOCUMENTS

CN 204530533 U * 8/2015

OTHER PUBLICATIONS

English language translation of CN204530533U, generated on Apr. 13, 2021 with Espacenet website (https://www.epo.org/searching-for-patents/technical/espacenet.html).*

* cited by examiner

*Primary Examiner* — Mark Ruthkosky
*Assistant Examiner* — Julie L Rummel

(57) ABSTRACT

A disclosed artificial tree includes telescoping tubes in series of progressively smaller diameters nested within each other. The telescoping pole is engineered to erect in response to an erecting force. A base is configured to support the telescoping pole orthogonal to a top side of the base parallel to a floor side of the base. The base includes a release control switch for erection and for retraction of the artificial tree. An artificial helical bough encircles the telescoping pole many times. The artificial helical bough is mounted at an outside end to the base and mounted on an inside end to a smallest diameter telescoping tube. The artificial helical bough is preconfigured with an engineered spring force greater than a weight of the bough plus a weight of the telescoping pole to erect the artificial tree based on a state of the release control switch.

17 Claims, 4 Drawing Sheets

SELF-ASSEMBLING ARTIFICIAL TREE

BACKGROUND

It is a frustrating thing to have to put away a Christmas tree after working so hard to put it up in the first place along with all the other work it takes to pull off the holidays. Great strides have been taken in the direction of convenient Christmas tree put-up and takedown but still much remains to be done to streamline this activity into busy family schedules.

Pre-lit Christmas trees are now commonplace and usually come in sections that still require assembly. It is still a chore to dig out the artificial Christmas tree from storage and to try and fit it back in again when all is said and done. On the other hand, hiring out a Christmas tree service is expensive and not very schedule convenient.

There exists a need for a more convenient artificial tree put-up and take down, especially for Christmas trees that is not being met by any known or disclosed device or system of present.

SUMMARY OF THE INVENTION

A disclosed artificial tree includes a telescoping pole configured to have a plurality of telescoping tubes in series of progressively smaller diameters nested within each other. The telescoping pole is engineered to erect in response to an erecting force. A base is configured to support the telescoping pole orthogonal to a top side of the base parallel to a floor side of the base. The base includes a release control switch for erection and for retraction of the artificial tree. An artificial helical bough encircles the telescoping pole many times. The artificial helical bough is mounted at an outside end to the base and mounted on an inside end to a smallest diameter telescoping tube. The artificial helical bough is preconfigured with an engineered spring force greater than a weight of the bough plus a weight of the telescoping pole to erect the artificial tree based on a state of the release control switch.

A method of erecting and retracting an artificial tree is disclosed. The method includes providing a telescoping pole 210 configured to have a plurality of telescoping tubes in series of progressively smaller diameters nested within each other, the telescoping pole configured to erect in response to an erecting force. The method also includes providing a base 220 configured to support the telescoping pole orthogonal to a top side of the base parallel to a floor side of the base, the base comprising a release control switch for erection and for retraction of the artificial tree. The method additionally includes providing an artificial helical bough 230 mounted at an outside end to the base and mounted on an inside end to a smallest diameter telescoping tube, the artificial helical bough preconfigured with a torsional spring force. The method further includes controlling the outside end of the artificial helical bough 240 in relation to the base via an electric motor to facilitate an erection and a retraction via increasing and decreasing a torsional force on the artificial helical bough.

Figure 1:
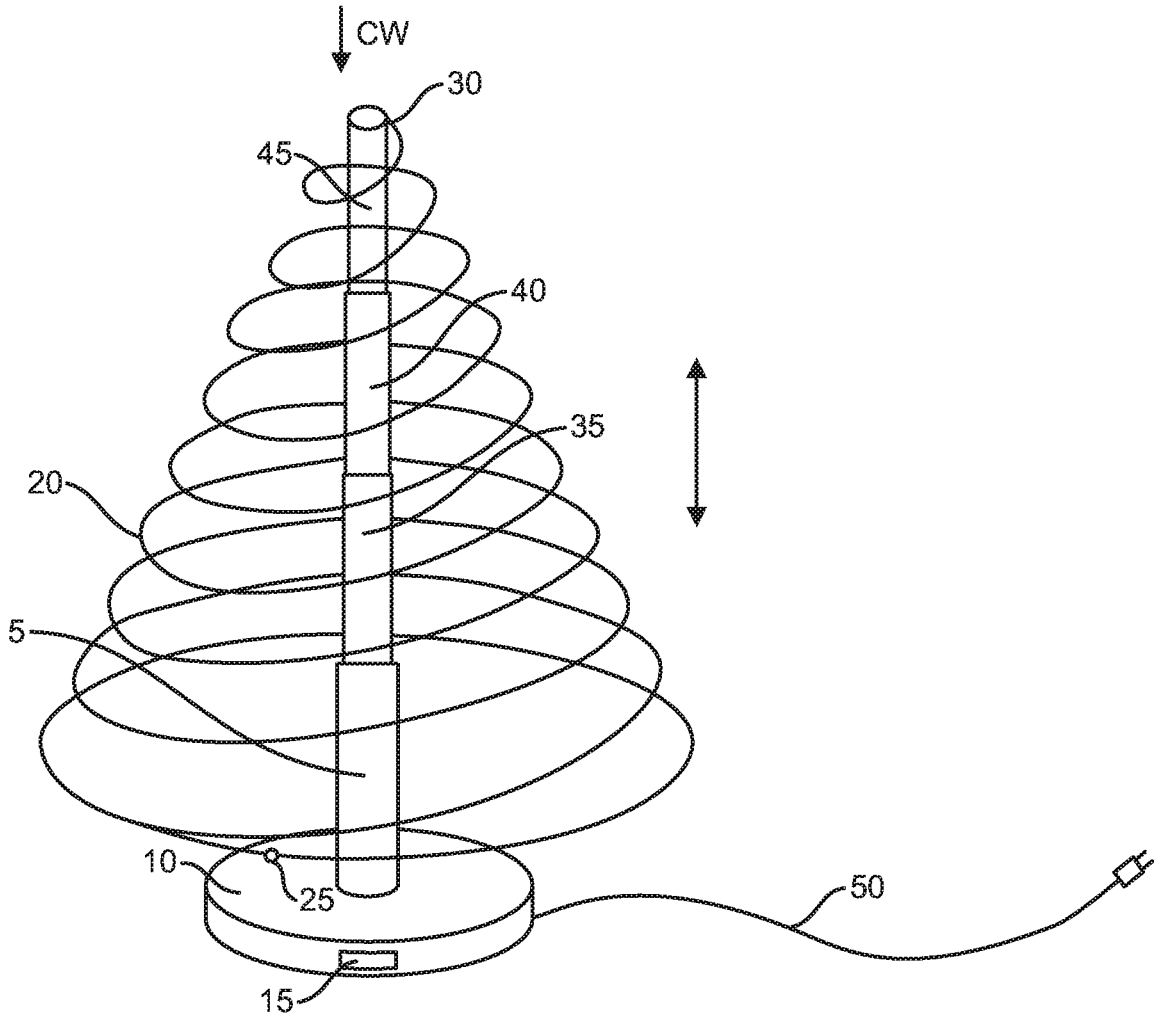
FIG. 1 is an orthogonal view of a self-assembling artificial tree in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Throughout the present disclosure the term 'erection' is used to refer to an extension of an artificial true to its predetermined height. The term 'helical' refers in the common sense to a spiral configuration not unlike threads of a screw. The term, 'spring force,' refers to a force exerted by a spring over a distance x given by $F=-kx$ where k is a constant of the material of the spring. Since gravity on a mass is given by $F=ma$, the resulting relationship is given by $-kx=ma$ where a is 9.8 m/second squared. Therefore, the force $-kx$ is greater than the mass of the artificial helical bough plus the mass of the telescoping tube times the acceleration of gravity in order for the artificial tree to self-assemble. The torsional spring force opposes a twisting of a spring and is related to the spring force exerted over a distance x. The torsional spring force has memory and wants to rest at equilibrium. The torsional spring force may be increased by twisting a spring tight, sometimes even decreasing a diameter of a portion of the spring. A tighter spring will have a greater force over distance x.

FIG. 1 is an orthogonal view of a self-assembling artificial tree in accordance with an embodiment of the present disclosure. The depicted artificial tree includes a telescoping pole 5 configured to have a plurality of telescoping tubes in series of progressively smaller diameters nested within each other. The telescoping pole 5 is engineered to erect in response to an erecting force. A base 10 is configured to support the telescoping pole 5 orthogonal to a top side of the base parallel to a floor side of the base. The base includes a release control switch 15 for erection and for retraction of the artificial tree. An artificial helical bough 20 encircles the telescoping pole 5 many times. The artificial helical bough 20 is mounted at an outside end 25 to the base and mounted on an inside end 30 to a smallest diameter telescoping tube 45. Four telescoping tubes 5, 35, 40 and 45 are depicted but any number of telescoping tubes may enable the disclosure. The artificial helical bough 20 is preconfigured with an engineered spring force greater than a weight of the bough plus a weight of the telescoping pole to erect the artificial tree based on a state of the release control switch. A power cord is available in embodiments having an electric motor in the base 10.

Embodiments of the release control switch keep the artificial helical bough in torsion based on a retraction of the telescoping pole and a retraction of the artificial helical bough. A retraction of the erected tree is accomplished by a gentle downward pushing force on the smallest diameter telescoping tube to take the tree into a collapsed torsion mode. The artificial helical bough further comprises an evergreen flocking and a plurality of Christmas decorations.

Figure 2:
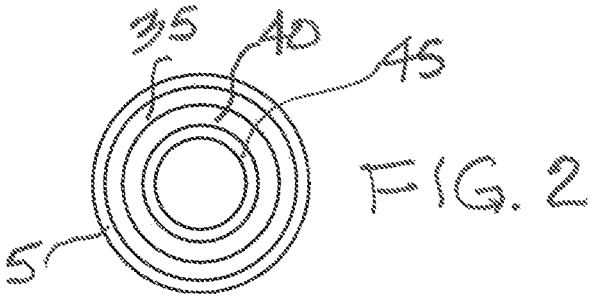
FIG. 2 a top view of a telescoping pole for the self-assembling tree in accordance with an embodiment of the present disclosure.

FIG. 2 a top view of a telescoping pole for the self-assembling tree in accordance with an embodiment of the present disclosure. The view includes telescoping tubes 5, 35, 40 and 45 within each other of decreasing diameter.

Figure 3:
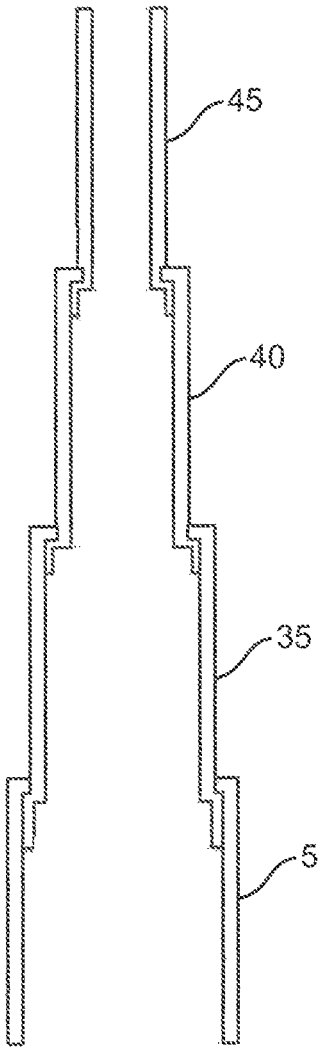
FIG. 3 is a cutaway view of the telescoping pole for the self-assembling tree in accordance with an embodiment of the present disclosure.

FIG. 3 is a cutaway view of a telescoping pole for the self-assembling tree in accordance with an embodiment of the present disclosure. The view includes telescoping tubes 5, 35, 40 and 45 interlocking within each other of decreasing diameter.

An electric motor (not depicted inside the base) is engineered to tighten the outside end of the artificial helical bough in relation to the base to increase a torsional spring force of the artificial helical bough and facilitate the erection of the artificial tree. The electric motor configured to loosen the outside end of the artificial helical bough in relation to the base to respectively decrease a torsional spring force of the artificial helical bough and facilitate a retraction of the artificial tree.

Figure 4:
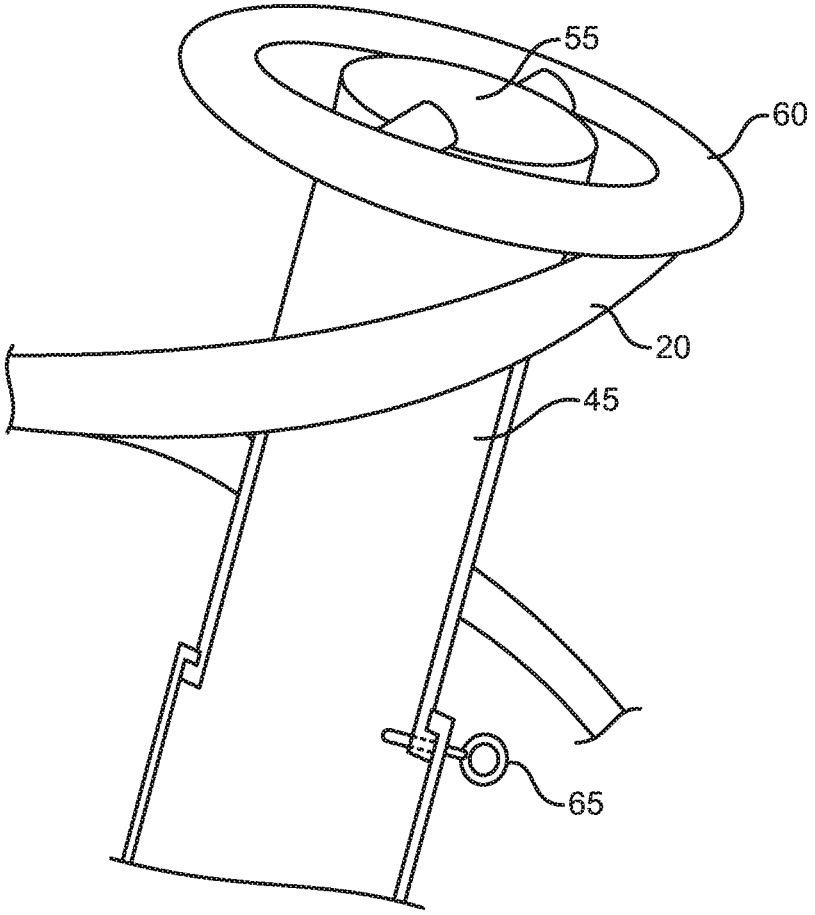
FIG. 4 is a close-up detail of a top and smallest diameter telescoping tube in accordance with an embodiment of the present disclosure.

FIG. 4 is a close-up detail of a top and smallest diameter telescoping tube in accordance with an embodiment of the present disclosure. The detail includes the artificial helical bough 20, the smallest diameter and last telescoping tube 45, the top cap 55 and a ring 60 stationary to the top cap 55. The pin 65 is inserted after erection to take pressure off the spring force of the artificial helical bough 20. Similar pins are insertable for each transition from a telescoping tube to another of lesser diameter.

Other embodiments include a top cap configured to be stationary with respect to the smallest diameter telescoping tube. Furthermore, stop pins are insertable from one telescoping tube into another to prevent turning the telescoping tubes during use. A height of the artificial tree based on a telescoping length of the telescoping pole. A worm gear relation connects the outside end of the helical bough and the electric motor.

Figure 5:
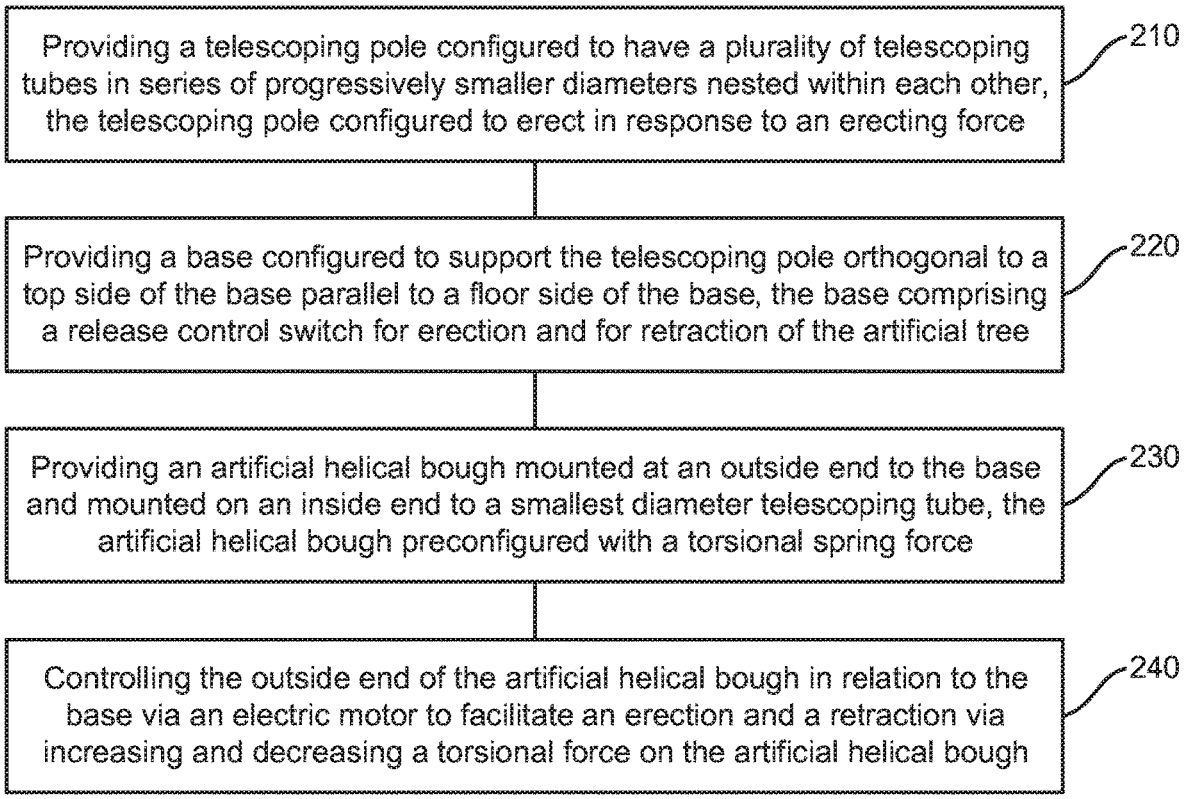
FIG. 5 is a relational block diagram and flow chart of the self-assembling artificial tree in accordance with an embodiment of the present disclosure.

FIG. 5 is a relational block diagram and flow chart of the self-assembling artificial tree in accordance with an embodiment of the present disclosure. The method includes providing a telescoping pole 210 configured to have a plurality of telescoping tubes in series of progressively smaller diameters nested within each other, the telescoping pole configured to erect in response to an erecting force. The method also includes providing a base 220 configured to support the telescoping pole orthogonal to a top side of the base parallel to a floor side of the base, the base comprising a release control switch for erection and for retraction of the artificial tree. The method additionally includes providing an artificial helical bough 230 mounted at an outside end to the base and mounted on an inside end to a smallest diameter telescoping tube, the artificial helical bough preconfigured with a torsional spring force. The method further includes controlling the outside end of the artificial helical bough 240 in relation to the base via an electric motor to facilitate an erection and a retraction via increasing and decreasing a torsional force on the artificial helical bough.

Embodiments of the disclosure further include keeping the artificial helical bough in torsion via the release control switch in a retracted and in a erected position and in zero torsion at a midpoint there between. Retracting the erected tree is accomplished via a gentle downward pushing force on the smallest diameter telescoping tube to take the tree into a collapsed torsion mode. The artificial tree is changed via decorating the artificial helical bough in an evergreen flocking and a plurality of Christmas decorations or in apple tree leaves, or any type of flocking and ornamental decorations to suit the owner's taste and any occasion.

The electric motor helps to erect the artificial tree via tightening the outside end of the artificial helical bough in relation to the base via the electric motor to increase a torsional spring force of the artificial helical bough and facilitate the erection of the artificial tree. The electric motor also helps to retract the tree via loosening the outside end of the artificial helical bough in relation to the base via the electric motor to respectively decrease a torsional spring force of the artificial helical bough and facilitate a retraction of the artificial tree.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. An artificial tree that is movable from a retracted position to an erected position, comprising:

a telescoping pole comprising a plurality of telescoping tubes of progressively decreasing diameters, wherein the telescoping tubes of the plurality are configured to be nested within each other when the tree is in the retracted position and the telescoping pole is configured to erect in response to an erecting force;

a base comprising a top side that is parallel to a floor side and a release control switch for erection and retraction of the artificial tree, wherein the base supports the telescoping pole in an orientation orthogonal to the top side;

an artificial helical bough preconfigured with an engineered spring force and comprising an outside end and an inside end, wherein the helical bough encircles the telescoping pole, the outside end is mounted to the base, and the inside end is mounted to the smallest-diameter telescoping tube, and wherein the engineered spring force is greater than a weight of the bough plus a weight of the telescoping pole such that the artificial tree is erected in response to the release control switch being actuated; and an electric motor configured to tighten the outside end of the artificial helical bough in relation to the base to increase a torsional spring force of the bough in order to facilitate erection of the artificial tree and configured to loosen the outside end of the artificial helical bough in relation to the base to decrease a torsional soring force of the bow in order to facilitate retraction of the artificial tree.

2. The artificial tree of claim 1, wherein the release control switch keeps the artificial helical bough in torsion based on a retraction of the telescoping pole and a retraction of the artificial helical bough.

3. The artificial tree of claim 1, wherein a retraction of the erected tree is accomplished by a gentle downward pushing force on the smallest diameter telescoping tube to take the tree into a collapsed torsion mode.

4. The artificial tree of claim 1, wherein the artificial helical bough further comprises an evergreen flocking and a plurality of Christmas decorations.

5. The artificial tree of claim 1, further comprising a top cap adjoined to and stationary with respect to the smallest-diameter telescoping tube.

6. The artificial tree of claim 1, further comprising stop pins insertable from one telescoping tube into another to prevent turning the telescoping tubes during use.

7. The artificial tree of claim 1, wherein the artificial tree has a height based on a telescoping length of the telescoping pole.

8. The artificial tree of claim 1, further comprising a worm gear relation between the outside end of the helical bough and the electric motor.

9. A method for erection and retraction of an artificial tree, the method comprising:

providing an artificial tree comprising telescoping pole comprising a plurality of telescoping tubes of progressively decreasing diameters, wherein the telescoping tubes of the plurality are configured to be nested within each other when the tree is in a retracted position and the telescoping pole is configured to erect in response to an erecting force;

a base comprising a too side that is parallel to a floor side and a release control switch for erection and retraction of the artificial tree, wherein the base supports the telescoping pole in an orientation orthogonal to the top side;

an artificial helical bough preconfigured with an engineered spring force and comprising an outside end and an inside end, wherein the helical bough encircles the telescoping pole, the outside end is mounted to the base, and the inside end is mounted to the smallest-diameter telescoping tube, and wherein the engineered spring force is greater than a weight of the bough plus a weight of the telescoping pole such that the artificial tree is erected in response to the release control switch being actuated; and an electric motor configured to tighten the outside end of the artificial helical bough in relation to the base to increase a torsional spring force of the bough in order to facilitate erection of the artificial tree and configured to loosen the outside end of the artificial helical bough in relation to the base to decrease a torsional spring force of the bow in order to facilitate retraction of the artificial tree; and controlling the outside end of the artificial helical bough in relation to the base via the electric motor to facilitate erection and retraction of the artificial tree via increasing and decreasing a torsional force on the artificial helical bough.

10. The method of claim 9, wherein the release control switch keeps the artificial helical bough in torsion in a retracted position and in an erected position, and in zero torsion at a midpoint therebetween.

11. The method of claim 9, further comprising retracting the erected tree via gentle downward pushing force on the smallest diameter telescoping tube to take the tree into a collapsed torsion mode.

12. The method of claim 9, further comprising decorating the artificial helical bough with evergreen flocking and a plurality of Christmas decorations.

13. The method of claim 9, further comprising tightening the outside end of the artificial helical bough in relation to the base via the electric motor to increase a torsional spring force of the artificial helical bough and facilitate the erection of the artificial tree.

14. The method of claim 9, further comprising applying a force to the outside end of the artificial helical bough in relation to the base via the electric motor to respectively decrease the torsional spring force of the artificial helical bough and facilitate a retraction of the artificial tree.

15. The method of claim 9, further comprising keeping a top cap stationary with respect to the smallest-diameter telescoping tube.

16. The method of claim 9, further comprising inserting a stop pin extending from one telescoping tube into another to prevent turning the telescoping tubes during use.

17. Thea method of claim 9, further comprising controlling the outside end of the artificial helical bough via a worm gear relation between the outside end of the helical bough and the electric motor and base.

* * * * *